US005780800A

United States Patent [19]

Palmieri et al.

[11] Patent Number: 5,780,800

[45] Date of Patent: Jul. 14, 1998

[54] CIRCUIT BREAKER CONTACT ARM AND SPRING SHIELD

[75] Inventors: Joseph M. Palmieri, Southington; J. Peter McCuin, Bristol; George J. Boucher, Plainville, all of Conn.

[73] Assignee: General Electric Company, New York, N.Y.

[21] Appl. No.: 693,420

[22] Filed: Aug. 7, 1996

[51] Int. Cl.[6] ..... H01H 9/30

[52] U.S. Cl. ..... 218/147; 218/27; 218/32; 218/34; 218/41; 218/89; 335/201

[58] Field of Search ..... 218/22, 27, 30, 218/32, 34, 41, 89, 146, 147, 156, 136; 335/2, 196, 201, 202, 203

[56] References Cited

U.S. PATENT DOCUMENTS

| | | | |
|---|---|---|---|
| 3,582,966 | 6/1971 | Strobel | 218/146 |
| 4,409,444 | 10/1983 | Yoshiyasu et al. | 218/136 |
| 4,431,877 | 2/1984 | Heft et al. . | |
| 4,459,445 | 7/1984 | Hisatsune et al. | 218/146 |
| 4,484,045 | 11/1984 | Seymour et al. . | |
| 4,551,701 | 11/1985 | Ubukata et al. | 218/147 X |
| 4,659,887 | 4/1987 | Belbel et al. . | |
| 4,679,016 | 7/1987 | Ciarcia et al. . | |
| 4,716,265 | 12/1987 | Fujii et al. . | |
| 4,752,660 | 6/1988 | Yokoyama et al. . | |
| 4,945,327 | 7/1990 | Doughty et al. . | |
| 5,337,031 | 8/1994 | Castonguay et al. . | |
| 5,361,052 | 11/1994 | Ferullo et al. . | |
| 5,389,906 | 2/1995 | Castonguay et al. . | |
| 5,440,284 | 8/1995 | Ferullo et al. . | |
| 5,581,063 | 12/1996 | Clark . | |

*Primary Examiner*—Khanh Dang
*Attorney, Agent, or Firm*—Richard A. Menelly; Carl B. Horton

[57] ABSTRACT

An arc isolation shield for molded case circuit breakers is inserted between the circuit breaker case and cover and attached to one leg of the operating cradle. The knee of the circuit breaker moveable contact arm contacts the bottom of the shield and moves the shield in unison with the contact arm to protect the contact arm, contact braid and operating spring upon contact separation under severe overcurrent conditions.

14 Claims, 3 Drawing Sheets

CIRCUIT BREAKER CONTACT ARM AND SPRING SHIELD

BACKGROUND OF THE INVENTION

Molded case circuit breakers rated for residential and lower current industrial applications utilize both thermally-responsive as well as magnetically-responsive trip units for overcurrent and short circuit interruption. The thermal element responds to moderate overcurrent conditions, whereas the magnetic trip unit responds to more severe overcurrent conditions. Upon occurrence of severe overcurrent conditions, an arc occurs between the contacts upon separation and is cooled or quenched by means of arc plates until extinction occurs upon current zero conditions.

The arc is usually accompanied by gaseous debris which should be shielded from the circuit breaker internal components. The circuit breaker operating spring that carries the moveable contact arm to the OPEN position as well as the moveable contact arm itself must be protected from the deleterious gaseous debris.

U.S. Pat. Nos. 4,431,877, 4,484,045, 4,716,265, 4,752,660, 4,945,327, 5,337,031, 5,361,052, 5,389,906 and 5,440,284 are representative of the recent state-of-the-art attempts to shield the moveable contact arm during arc occurrence. U.S. Pat. No. 4,659,887 entitled "Switch Device Having an Insulating Screen Inserted Between the Contacts During Breaking" describes the interposition of a shield between the arcing contacts as they separate to reduce the deleterious effects of the arc gases as well as cooling the arc gases in the process.

Since the prior arc screen devices require additional installation time and components, it would be economically advantageous to provide a shield that would protect the circuit breaker components from such deleterious effects minimum cost in time and components.

Accordingly, one purpose of the invention is to provide an arc shield for protecting circuit breaker components from arc gases with minimum cost and automated assembly.

SUMMARY OF THE INVENTION

A circuit breaker contact arm and operating spring shield is inserted between the circuit breaker arc chute and the contact arm to protect the contact arm from arc contamination upon overcurrent circuit interruption. The shield is in the form of a non-metallic plate that is affixed to the interior of the circuit breaker case without requiring adhesives or fasteners.

DESCRIPTION OF THE PREFERRED EMBODIMENT

Figure 1:
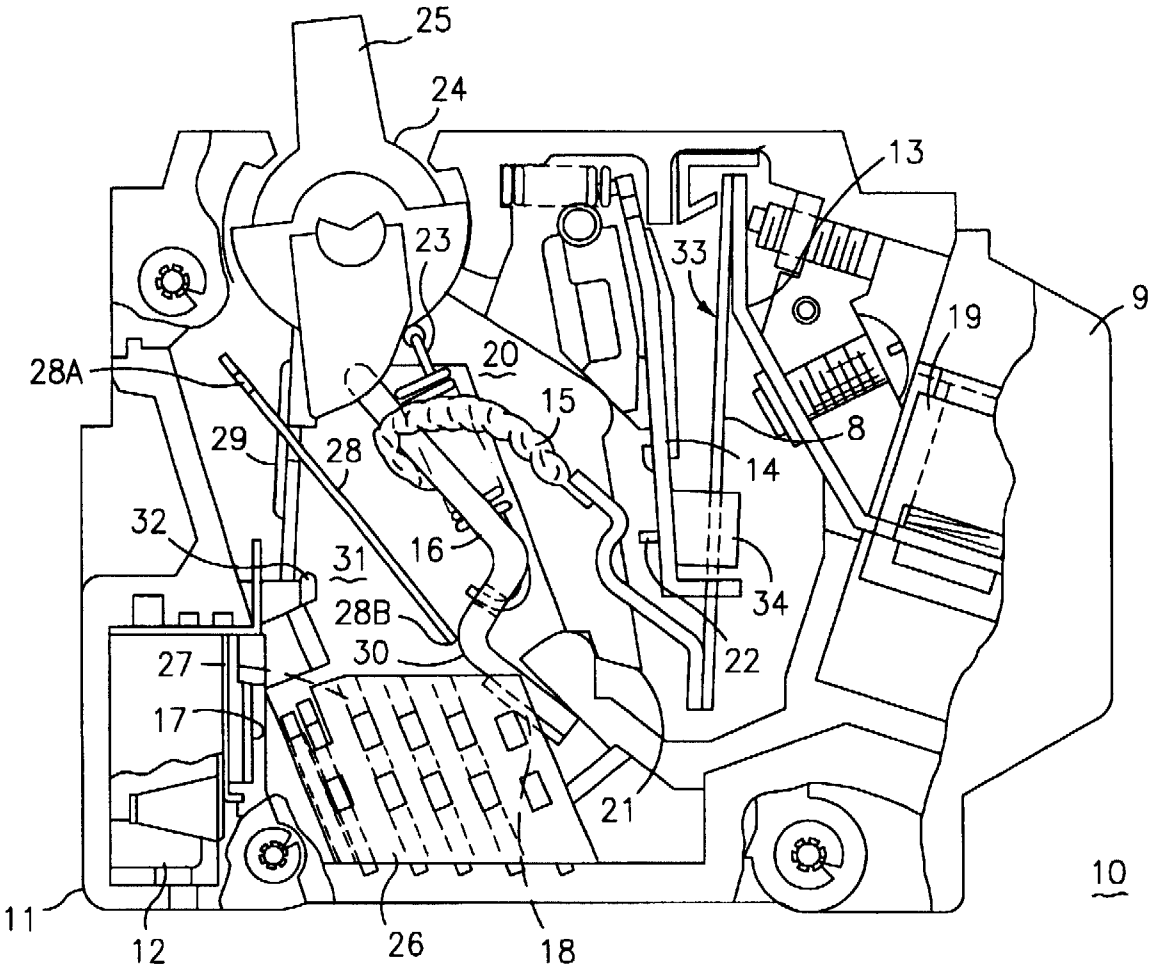
FIG. 1 is a side view of a molded case circuit breaker (trip condition) employing the arc shield according to the invention.
Figure 2:
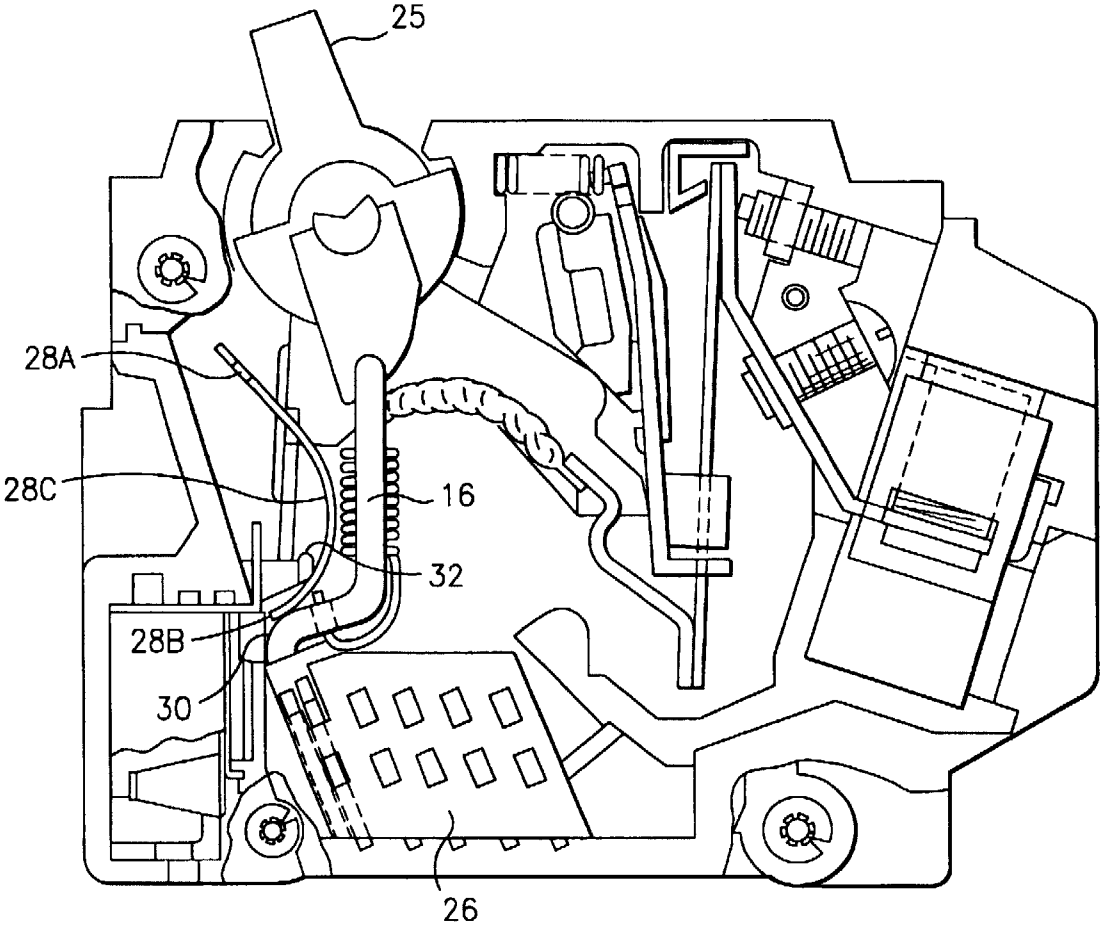
FIG. 2 is a side view of the circuit breaker of FIG. 1 with the contacts in the closed condition.

A molded case circuit breaker 10 is shown in FIGS. 1 and 2 consisting of a plastic case 11 to which electrical connection is made by means of a line terminal strap 12 and a load terminal strap 13 which connects with the associated electrical distribution system by means of the load lug 19. Most of the cover 9 is removed to clearly depict the internal operating components. The circuit through the circuit breaker proceeds through a bimetal 8 and braid conductor 15 to the movable contact arm 16 having a movable contact 18 attached thereto. Electrical connection is completed by means of a fixed contact 17, which connects by means of the line strap 12 with the associated electrical distribution circuit. The movable contact arm 16 operatively connects with an operating handle 25 by means of operating spring 23 and handle yoke 24. The operating spring is moved over center when the operating handle is in the ON position, as indicated in FIG. 2. The contacts are held in a closed position against the bias provided by the stretched operating spring 23 by the engagement between the tip 21 of the cradle 20 and the latch 22. The thermal-magnetic trip unit 33 includes a U-shaped magnet 34 which interacts with the armature 14 to attract the armature and remove the latch 22 from the cradle tip 21 upon the occurrence of an overcurrent condition. The operating spring then releases to draw the movable contact arm 16 and the movable contact 18 to the open position shown in FIG. 1. The circuit breaker 10 is similar to that described within U.S. Pat. No. 4,679,016 entitled "Interchangeable Mechanism For Molded Case Circuit Breaker" which patent should be reviewed for a better understanding of the interaction between the cradle and latch both retain and release the operating spring.

The planar arc shield 28 (hereinafter "shield 28") according to the invention is positioned on the cradle arm 29 by means of a slot 28A formed on a bottom edge of the shield. The bottom 28B of the shield is positioned next to and in abutment with the knee 30 on the contact arm 16 when the shield is in the unflexed position shown in FIG. 1 with the contacts separated and the operating handle in the TRIPPED position. This is the overcurrent condition whereby an arc forms between the contacts 17, 18 immediately upon separation. The arc is contained within the arc chamber 26 and is quenched and cooled by contact with the arc plates 27. In the unflexed position of the shield 28, the contact arm 16, braid conductor 15 and the operating spring 23 are completely isolated from the arc chamber 26 and hence are protected from the gaseous debris created during the overcurrent condition. The dimensions of the shield are selected such that there is a minimum clearance defined between the circuit breaker cover 9, case 11 and the shield 28 as the shield proceeds from the flexed to the unflexed positions. Upon resetting the contacts 17, 18 to the closed condition shown in FIG. 2, the operating handle 25 is rotated first in the clockwise direction to reset the operating spring 23 then in the counterclockwise direction to the ON position as viewed in FIG. 2 to close the contacts. Upon transfer of the contact arm 16 to the ON position of FIG. 2, the knee 30 strikes against the end 28B of the shield 28 driving the bottom half of the planar shield clockwise against the upstanding tab 32 formed in the bottom 31 of the case 11. The end 28B of the shield 28 is driven past the tab 32 causing the bottom half of the shield to flex to the position depicted at 28C in FIG. 2. Upon rotation of the operating handle from the ON to TRIPPED or OFF position of FIG. 1, the bottom half of the shield 28 transfers back to the unflexed condition of FIG. 1 by virtue of the mechanical memory of the material used to fabricate the planar shield. A material having high temperature resistance and retaining its physical properties after many arcing operations is "Nomex", which is a trademark of DuPont Co. for a high temperature resistant fibrous material. Other high temperature resistant materials having good mechanical memory may also be employed.

Figure 3:
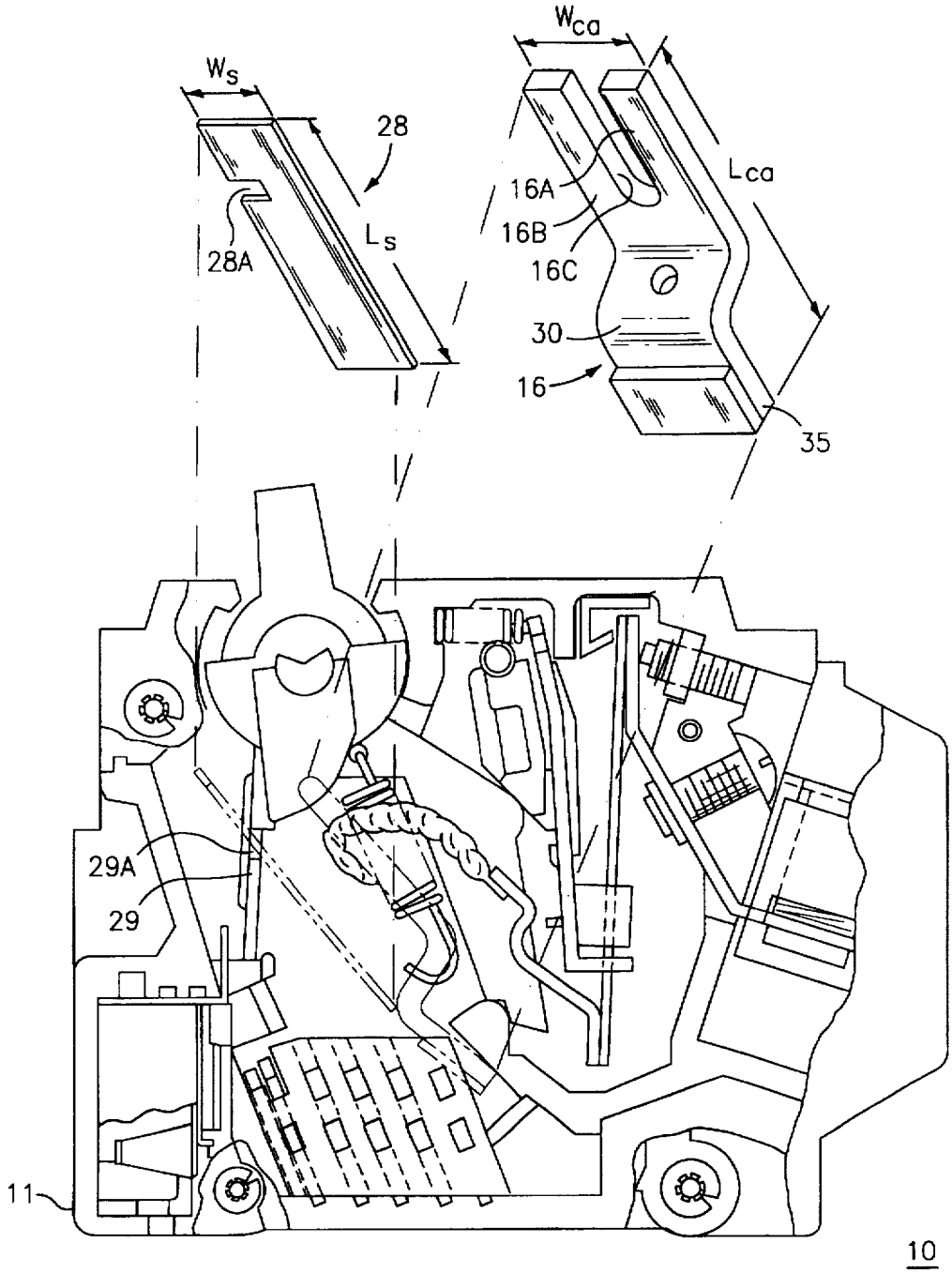
FIG. 3 is an enlarged top perspective view of a part of the circuit breaker of FIGS. 1 and 2 with the shield in isometric projection.

The circuit breaker 10 is shown in FIG. 3 to detail the dimensional relationship between the shield 28 and the contact arm 16 prior to insertion within the circuit breaker case 11. The slot 28A in the shield 28 that is inserted within the slot 29A in the cradle arm 29 is approximately one third from the top end of the shield to allow sufficient flex to the bottom two thirds for complete shielding to the associated contact arm 16. When the width Ws of the shield 28 is coextensive with the width Wca it is found that the gases generated by the ensuing arc upon contact separation upon severe overcurrent conditions strike against the side of the shield opposite from the contact arm and substantial contribute to the motivation of the contact arm by contact between the knee 30 of the contact arm 16 and the bottom 28B of the shield 28 as the contact arm moves from the closed condition of FIG. 2 to the open condition of FIG. 1. The width Wca includes the operating spring clearance slot 16C as defined between the parallel arms 16A, 16B while the length Lca includes the knee 30 and the bottom 35, as indicated in FIG. 3. The flexing of the contact arm provides stored mechanical energy in addition to the gas-generated forces to assist the charged contact spring 23 shown in FIG. 2 in moving the contact arm from the closed to the open position. As further shown in FIG. 3, the length Ls of the shield 28 is greater than the length Lca of the contact arm 16 to insure that the contact arm is completely isolated from the arc gas effluents.

A simple and inexpensive shield has herein been described that protects the circuit breaker moveable contact arm, braid and operating spring from contamination caused by gaseous effluents that are generated upon contact separation upon severe overcurrent conditions. The physical properties and dimensions of the shield are selected to provide motive force to the contact arm during transition from the closed to open positions.

We claim:

1. An arc shield for circuit breakers having a moveable contact arm, a case and a cover comprising:

a strap of electrically-insulating material having a width and a length defining a rectangle;

a slot within one side of said rectangle, said slot is positioned along said length defining a top part and a bottom part to said rectangle, said top part being of shorter length than said bottom part for promoting flex of said arc shield in transport with said contact arm from overcurrent to quiescent conditions; and a bottom end of said rectangle arranged for abutting said circuit breaker movable contact arm whereby said rectangle moves in unison with said contact arm to protect said contact arm from arc-generated debris when said contact arm moves in response to severe overcurrent conditions through said contact arm.

2. The arc shield of claim 1 wherein said material comprises fiber.

3. The arc shield of claim 1 wherein said bottom is positioned relative to a tab upstanding from a circuit breaker case for deterring movement of said top part of said shield and causing said top part flex about said tab.

4. The arc shield of claim 1 wherein said rectangle defines a first width coextensive with a second width defined by said circuit breaker contact arm for protecting said contact arm from arc gas debris.

5. The arc shield of claim 1 wherein said first width defines a clearance fit between a circuit breaker case and a circuit breaker cover for allowing said shield to transport within a circuit breaker without passage of arc gas debris along said circuit breaker case and said circuit breaker cover.

6. The arc shield of claim 1 wherein said fiber comprises a Nomex fiber.

7. A circuit breaker comprising in combination:

a molded plastic case and a molded plastic cover;

a fixed and a movable contact within said case and cover;

a movable contact arm within said case and cover, said movable contact being attached to one end of said movable contact arm, said movable contact arm being arranged for moving said movable contact away from said fixed contact under the urgence of an operating spring upon occurrence of overcurrent conditions within a protected circuit;

a rectangular shield within said case and cover, a part of said shield arranged for movement with said moveable contact arm to isolate said contact arm from arc debris generated when said moveable contact moves away from said fixed contact; and an operating cradle within said case and cover, one part of said cradle adapted for restraining movement of said movable contact arm under quiescent conditions within said protected circuit and another part of said cradle adapted to retain said shield.

8. The circuit breaker of claim 7 wherein said shield comprises:

a strap of electrically-insulating material having a width and a length defining a rectangle;

a slot within one side of said rectangle, said slot arranged for insertion on said other part of said circuit breaker operating cradle; and a bottom of said rectangle arranged for abutting said circuit breaker moveable contact arm whereby said rectangle moves in unison with said contact arm to protect said contact arm from arc-generated debris when said contact arm moves in response to severe overcurrent conditions through said contact arm.

9. The circuit breaker of claim 8 wherein said material comprises fiber.

10. The circuit breaker of claim 8 wherein said slot is positioned along said length defining a top part and a bottom part to said rectangle, said top part being of shorter length than said bottom part for promoting flex of said arc shield in transport with said contact arm from overcurrent to quiescent conditions.

11. The circuit breaker of claim 10 wherein said bottom is positioned relative to a tab upstanding from said circuit breaker case for deterring movement of said top part of said shield and causing said top part flex about said tab.

12. The circuit breaker of claim 8 wherein said rectangle defines a first width coextensive with a second width defined by said movable contact arm for protecting said movable contact arm from arc gas debris.

13. The circuit breaker of claim 12 wherein said first width defines a clearance fit between said circuit breaker case and said circuit breaker cover for allowing said shield to transport within a circuit breaker without passage of arc gas debris along said circuit breaker case and said circuit breaker cover.

14. The circuit breaker of claim 9 wherein said fiber comprises a Nomex fiber.

* * * * *